US006899587B2

(12) United States Patent
McClung et al.

(10) Patent No.: US 6,899,587 B2
(45) Date of Patent: May 31, 2005

(54) FLYER DISCS

(76) Inventors: Karen Therese McClung, 16690 Champion Forest Dr., Spring, TX (US) 77379; Sarah Therese McClung, 16690 Champion Forest Dr., Spring, TX (US) 77379; Elizabeth Marie McClung, 16690 Champion Forest Dr., Spring, TX (US) 77379; John Michael McClung, 16690 Champion Forest Dr., Spring, TX (US) 77379; Guy LaMonte McClung, IV, 16690 Champion Forest Dr., Spring, TX (US) 77379; Guy LaMont McClung, III, 16690 Champion Forest Dr., Spring, TX (US) 77379-7023

( * ) Notice: Subject to any disclaimer, the term of this patent is extended or adjusted under 35 U.S.C. 154(b) by 0 days.

(21) Appl. No.: 10/268,045

(22) Filed: Oct. 9, 2002

(65) Prior Publication Data

US 2003/0092350 A1 May 15, 2003

Related U.S. Application Data

(62) Division of application No. 09/871,170, filed on May 31, 2001, now Pat. No. 6,585,551.

(51) Int. Cl.[7] ..... A63H 27/00

(52) U.S. Cl. ..... 446/46; 446/48; 473/588

(58) Field of Search ..... 446/46, 47, 48, 446/42–45, 36–39; 473/588, 569, 573–574; 273/425, 426, 398, 401–404, 407; 229/103, 109; 206/408, 216, 551, 315.1

(56) References Cited

U.S. PATENT DOCUMENTS

| | | | | | |
|---|---|---|---|---|---|
| 4,203,249 | A | * | 5/1980 | Bohm | 46/74 D |
| 5,110,038 | A | * | 5/1992 | Pantisano et al. | 229/103 |
| 5,326,299 | A | * | 7/1994 | Jasinski | 446/46 |
| 5,853,311 | A | * | 12/1998 | Bartholomew | 446/48 |
| 5,876,108 | A | * | 3/1999 | Chien | 362/35 |

FOREIGN PATENT DOCUMENTS

GB 2250212 * 3/1992

* cited by examiner

*Primary Examiner*—Derris H. Banks
*Assistant Examiner*—Jamila O Williams
(74) *Attorney, Agent, or Firm*—Guy McClung

(57) ABSTRACT

A flying disc which in certain aspects has a disc body having an outer perimeter and a plurality of cuts, indentations, grooves, and/or weakened areas spaced-apart around the outer perimeter, and at least one portion [or a plurality thereof] of the disc body between at least one pair of the cuts, etc., said portion(s) folded from the disc body. In certain aspects such a disc has a weight or weights, secondary piece or secondary disc connected to the disc body on either the top or bottom thereof, the weights(s), secondary piece or disc for facilitating flight of the disc body.

19 Claims, 5 Drawing Sheets

FIG.1A
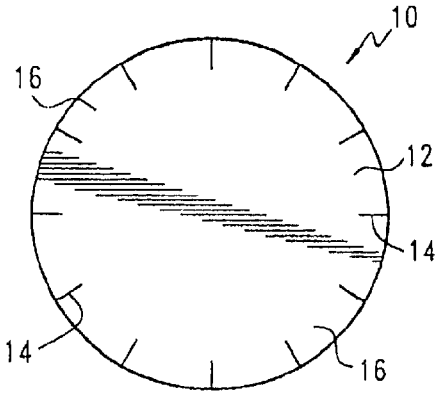
FIG.1B
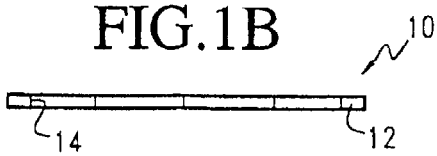
FIG.1C
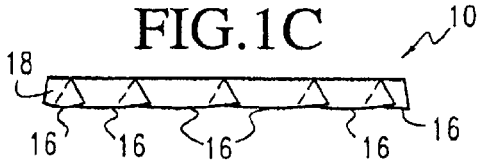
FIG.2A
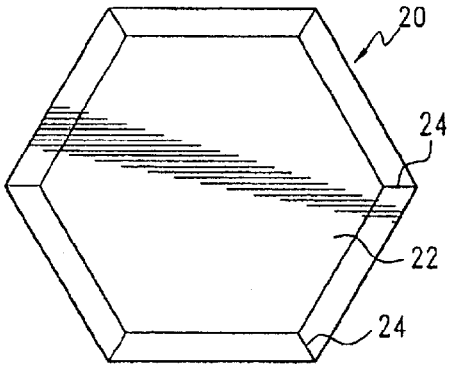
FIG.2B
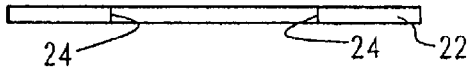
FIG.2C
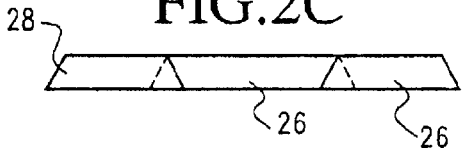
FIG.3A
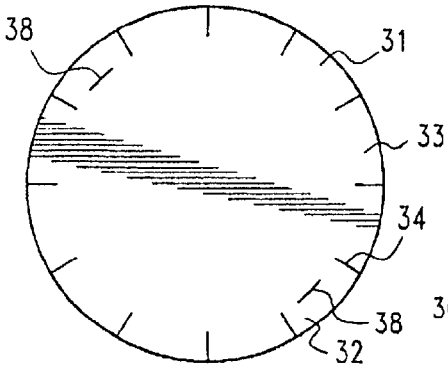
FIG.3B
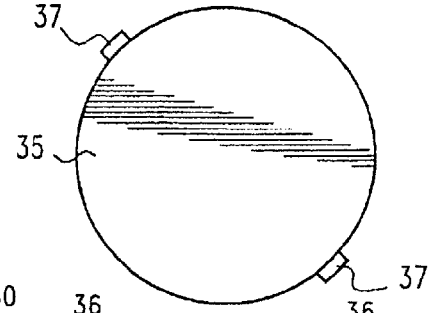
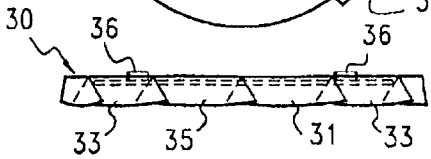
FIG.3C FIG.1D
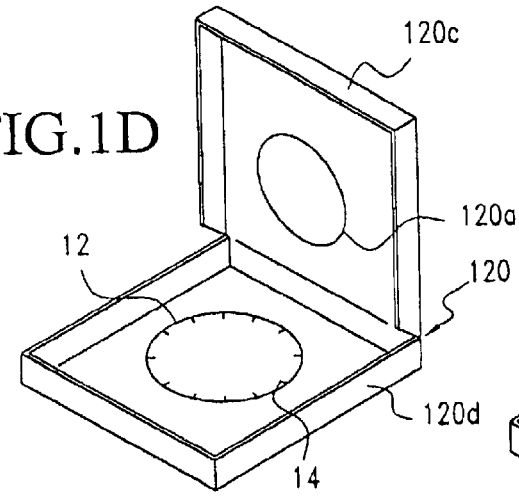
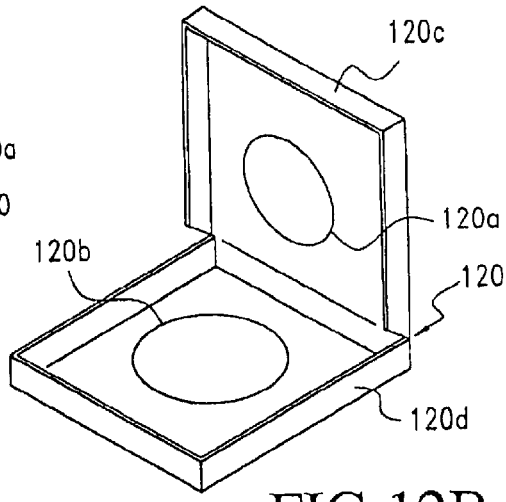
FIG.12B
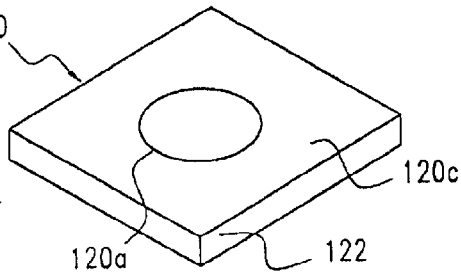
FIG.12A
FIG.12C
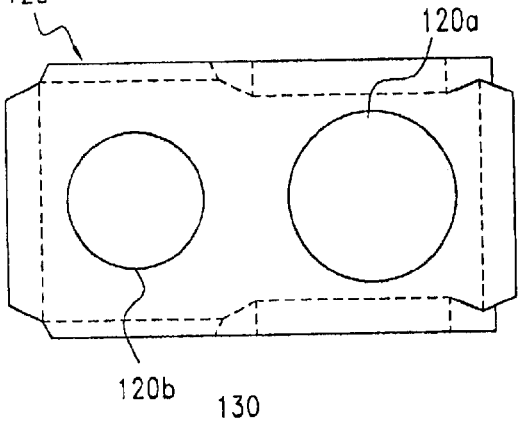
FIG.12D
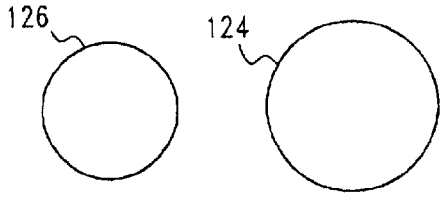
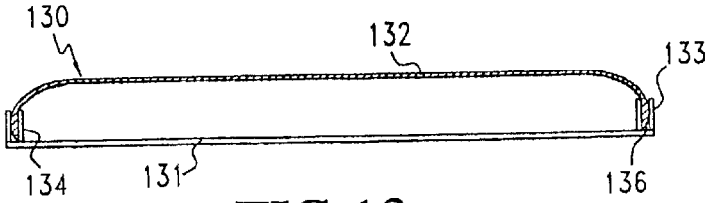
FIG.13

FIG.4A
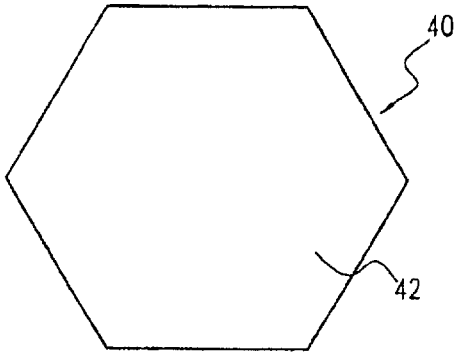
FIG.4B
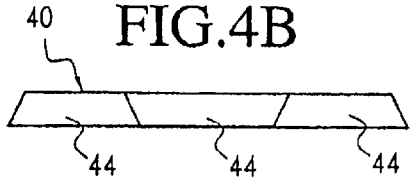
FIG.5
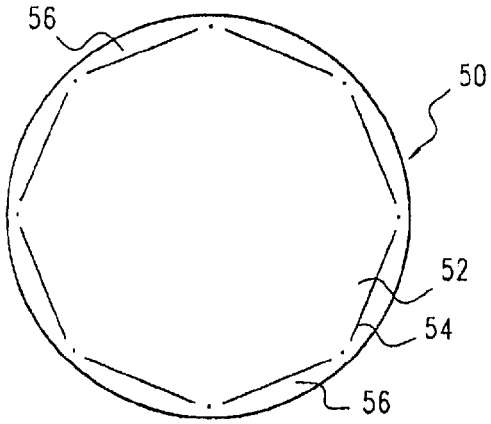
FIG.6
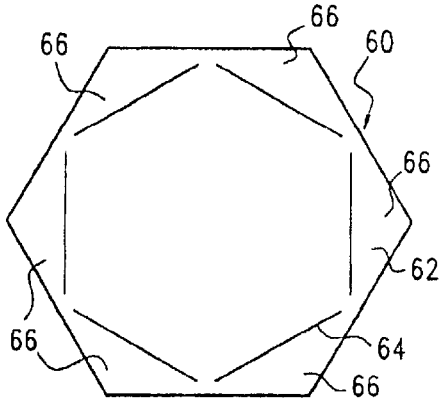
FIG.7A
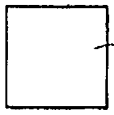
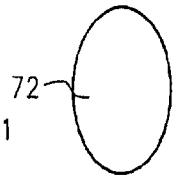
FIG.7B
FIG.7C
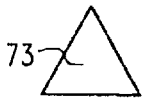
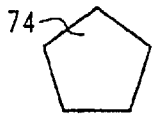
FIG.7D
FIG.7E
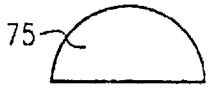
FIG.8
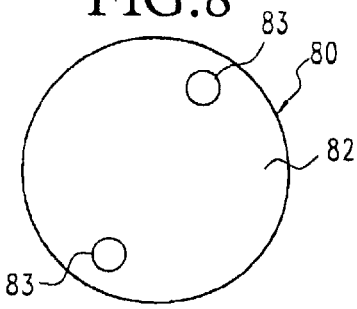
FIG.9A
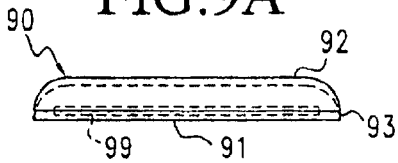
FIG.9B
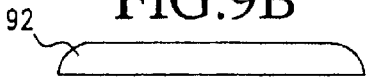

FLYER DISCS

RELATED APPLICATION

This is a division of U.S. application Ser. No. 09/871,170 filed May 31, 2001 now U.S. Pat. No. 6,585,551, which is incorporated fully herein for all purposes.

BACKGROUND OF THE INVENTION

1. Field of the Invention

This invention is directed to flying discs, and to items with them.

2. Description of Related Art

The prior art discloses a wide variety of flying discs, flying objects, and toys, e.g. those disclosed in U.S. Pat. Nos. 5,799,616; 5,553,570; and 6,073,588; pending application Ser. No. 09/592,976 filed Jun. 12, 2000; pending application entitled "Flying Disc with Compact Disc" filed, May 23, 2001 naming McClung, III and Van Natter III as inventors; and in the prior art cited in these applications and patents—all of which are incorporated fully herein for all purposes.

SUMMARY OF THE PRESENT INVENTION

The present invention, in certain embodiments discloses a flying disc made, e.g., from cardboard. In certain aspects, a portion or portions around the disc periphery are folded and/or bent down. In one aspect these portions extend continuously completely around the discs perimeter.

Cardboard, plastic or similar material which is sufficiently rigid may be used for the disc body so that the disc body will remain flat or substantially flat in flight. In certain aspects the disc is generally square, rectangular, triangular, pentagonal, quadragonal, hexagonal, septagonal, octagonal, oval, or ciruclar as viewed from above, but it may have any shape (as viewed from above or below) which serves as the body for the flying disc. Any such shape may have one or more cut-out portions. The folded or bent portions may be in contact with, not be interconnected with or interlocked with adjacent portions; or, alternatively, these portions may contact each other, be taped together, be interconnected, and/or be interlocked with each other.

In one aspect such a disc is made by cutting out, tearing out, or punching out a disc piece with the desired shape from a larger piece of plastic, paper, foam board, fiberboard, kraft paper, cardboard, etc. Slits, weakened areas, grooves, indentations, and/or cuts are then made around the discs perimeter (or this may be done before the disc piece is cut or punched out from the larger piece of material). A portion or portions of the disc (one, two, three, four, five, six, seven, eight, nine, ten, eleven, twelve, or more) between pairs of slits etc. are then folded down. These slits may, in certain aspects, point generally toward a center of the disc. Alternatively, weakened or slit lines marked (e.g. marked in ink) on top of the disc around its circumference (e.g. which do not point at the disc center on a point rather at two points on the disc's perimeter) provide lines down from which a part of the disc body can be bent or folded to provide the portion or portions projecting down from the disc body to facilitate its flight. In one particular aspect this produces an intermittent lip around the disc perimeter that facilitates the flight of the disc (as compared to a flat piece of material with no such lip or portions). Alternatively, parts of the disc are folded or bent down around the disc perimeter without the aid of slots, marks, etc.

In one embodiment two (or more) discs are connected together. In one such multi-disc assembly, two such discs are connected face-to-face so that the slits or cuts in the downward projecting edge of one disc are offset from those of the other disc. In another aspect a first disc with the intermittent lip of folded-down portions is connected to and on top of a disc (or discs) with no such portions.

In another embodiment a secondary piece of material is connected face-to-face, on top of or beneath, a disc as described above. Such a secondary piece may be any desired shape and adds weight and/or stability and facilitates flight of a disc with the lip of the disc (the lip that includes the folded or bent down portions) on the lower side of the disc in flight. Alternatively any weight or weights may be connected to a disc to facilitate its flight (e.g., but not limited to, to facilitate disc flight so that the disc flies flat rather than turning, twisting or flipping over in flight) and/or to stabilize it.

In one particular embodiment the cardboard used to produce a disc according to the present invention is cut out of a box, as may be the secondary piece, or multiple discs of a multi-disc disc.

The disc and/or secondary piece may be cut from any suitable cardboard, foam board, thick paper, plastic, rigid material, or box or container made from these materials. In a particular aspect the disc and/or secondary piece are cut out or punched out from a cardboard pizza box. The outline of the disc body and/or of the secondary piece (and/or of multiple discs) may be printed or otherwise drawn or embossed on the box. Lines may be included to indicate where the material is to be folded, bent, torn or cut to form the portions of the lip that are folded down. Depending on the size of the box, and the desired disc size, multiple discs and secondary pieces may be torn, punched-out or cut from a single box. Alternatively, a box may be perforated or otherwise cut or weakened along the outlines of the disc(s) and/or secondary pieces to ease separation of them from the box. In certain aspects one or more portions of a secondary piece or of a second disc are formed, sized and configured to engage, interlock with, or fit into corresponding slits, openings, engagement recesses, or locking cutouts on a primary disc body. Such engagement etc. apparatus may be used with or without other ways to fasten a secondary piece or additional disc to a primary disc [including, but not limited to, with glue, adhesive, staple(s), brad(s), screw(s), releasably cooperating hook/loop fastener material [e.g. but not limited to Velcro (TM) material; tape; and/or string or thread]. Similarly a weight or weights may be connected to a primary disc according to the present invention with or without a secondary piece.

For use in the dark any disc, weight, or secondary piece may have one or more pieces of "glow in the dark" material or reflective material on it and/or one or more light sticks and/or battery or solar powered lights (such items and materials referred to collectively herein as "light material").

In one aspect a box from which a disc or secondary piece is taken may be used as a target and/or container at which a disc or discs are thrown. In one particular embodiment, a box or part of a box from which a disc is taken is used as a target. In one aspect, the newly-created opening (from which the disc was removed) is used as a target. In one aspect one or more additional discs is cut out or punched out from a first disc so that a smaller disc (or discs) is created that can more easily fly through the box opening corresponding to the first disc. Optionally, any such opening may be enlarged so that a disc may pass through it or a disc thus removed from a box may be reduced in size so it will pass through the opening.

In one particular aspect of the present invention a dual disc includes a first disc with a disc body with a peripheral lip and a groove or recess in the lip. This groove or recess is configured and sized for releasable receipt therein of the lip of a second disc. In one aspect such a dual disc combination is used as a container for an object or objects in a space between the two discs.

Any secondary piece (or secondary disc) or pieces and/or disc body may have indicia thereon, including, but not limited to, identification and/or scoring indicia. One primary disc may have connected thereto a plurality of secondary pieces on top and/or on bottom thereof.

For any disc according to the present invention for which a slit, perforated portion and/or weakened portion is provided for facilitating folding or bending of a disc periphery portion, such folding or bending may be done by folding or bending the disc material upwardly or downwardly (when the disc is held horizontally flat prior to such folding or bending). All folded portions may be folded down or up; or one or more folded portions may be up and one or more folded portions down.

What follows are some of, but not all, the objects of this invention. In addition to the specific objects stated below for at least certain preferred embodiments of the invention, other objects and purposes will be readily apparent to one of skill in this art who has the benefit of this invention's teachings and disclosures. It is, therefore, an object of at least certain preferred embodiments of the present invention to provide:

New, useful, unique, efficient, nonobvious flying discs and/or flyers, which in one aspect have one or more peripheral portions thereof folded or bent down and/or up from a main disc body;

Such discs taken from a larger piece of material which in one particular aspect is a cardboard box or part thereof; and Two or more such discs taken from a larger piece of material.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

FIG. 1A is a top plan view of a flying disc according to the present invention. FIG. 1B is a side view of the disc of FIG. 1A. FIG. 1C is a side view of the disc of FIG. 1A with portions folded down. FIG. 1D is a perspective view of a box according to the present invention.

FIG. 2A is a top plan view of a flying disc according to the present invention. FIG. 2B is a side view of the disc of FIG. 2A. FIG. 2C is a side view of the disc of FIG. 2A with portions folded down.

FIG. 3A is a top play view of a flying disc according to the present invention. FIG. 3B is a top plan view of a secondary piece for a multi-part disc according to the present invention. FIG. 3C is a side view of a multi-part disc according to the present invention with the flying disc of FIG. 3A and secondary piece of FIG. 3B.

FIG. 4A is a perspective view of a flying disc according to the present invention showing the top of the box. FIG. 4B is a side view of the disc of FIG. 4A.

FIG. 5 is a top plan view of a flying disc according to the present invention.

FIG. 6 is a top plan view of a flying disc according to the present invention.

FIGS. 7A–7E are a top plan views of flying discs according to the present invention.

FIG. 8 is a bottom view of a flying disc according to the present invention.

FIG. 9A is a side view of a flying disc container system according to the present invention. FIG. 9B is a side view of a flying disc of the system of FIG. 9A.

FIG. 12A is a perspective view of a box according to the present invention showing the top of the box. FIG. 12B is a perspective view of a box of FIG. 12A open with parts removed. FIG. 12C is a plan view of the box of FIG. 12A unfolded and flat. FIG. 12D is a top view of a disc and a secondary piece removed from the box of FIG. 12A.

FIG. 13 is a side view in cross-section of a flying disc container according to the present invention.

DESCRIPTION OF EMBODIMENTS PREFERRED AT THE TIME OF FILING FOR THIS PATENT

Figure 10A:
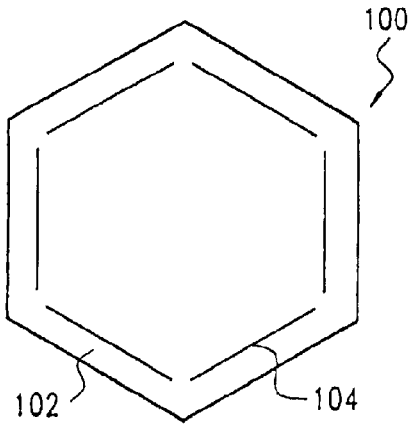
FIG. 10A is a top view of a flying disc according to the present invention.

Referring now to FIGS. 1A–1C, a flying disc 10 has a disc body 12 which is generally circular as viewed from above as in FIG. 1A. The disc body 12 has a plurality of spaced-apart slits 14 which go all the way through the disc body 12 (but which, according to the present invention, may be made so that they do not cut completely through the disc body 12). As shown in FIG. 1C, portions 16 of the disc body 12 between pairs of slits 14 have been bent down forming a downwardly projecting lip 18 around the perimeter of the disc body 12. Although the portions 16 are shown folded down in a scalloped arrangement (one side of a portion overlapping the adjacent portion), they may be folded down with two sides of one portion both overlapping adjacent portions. Also, as with any disc herein, if the slits 14 do not extend completely through the body 12, the portions 16 may be folded either way with respect to the slits 14; i.e., e.g. in FIG. 1B the portions 16 may be folded up or down. It is also within the scope of this invention to fold one or more portions 16 up and one or more down or to alternate up-down portions around a disc's perimeter.

The disc body 12 (and any disc body herein) may be made of any suitable material. For a circular disc (as viewed from above) any disc body disclosed herein and any circular secondary piece or disc may be any desired diameter. In certain aspects the disc body (and any disc body herein) is made of typical cardboard about one fourth of a centimeter or about one half of a centimeter thick which has an internal support structure, e.g. as the common cardboard used in typical cardboard boxes.

FIGS. 2A and 2B show a flying disc 20 according to the present invention which has a disc body 22 and spaced-apart slits 24. As shown in FIG. 2C portions 26 between pairs of slits 24 have been folded down to form a peripheral lip 28.

FIG. 3C shows a flying disc 30 according to the present invention which has a primary disc 31 with a disc body 32 and a plurality of bent down portions 33 between spaced-apart slits 34. Attached to or held within an underside of the disc body 32 is a secondary piece 35 (shown as circular in shape as viewed from above as in FIG. 3B, but which may be any desired shape). Staples 36 are shown connecting the secondary piece 35 to the disc body 32; but it is within the scope of this invention to use any suitable adhesives, glues, tapes, brads, nails, releasably cooperating hook-and-loop material, and/or mechanical connectors to connect the secondary piece to the disc body; and/or to fold the portions 33 so that the secondary piece is held within them; and/or to tape together, connect together, and/or interlock the portions 33 together to hold the secondary piece in place; and/or to attach, adhere, or connect the secondary piece to one, two, or more, or all of the portions 33. The secondary piece may be for facilitating flight of the disc 30/piece 35 and/or may have indicia and/or advertising thereon. In one particular embodiment in which a primary disc is cut from a cardboard box of cardboard about a quarter inch thick, the disc body is about ten and three-quarters inches in diameter and the secondary disc is about nine inches in diameter with the folded portions (eleven of them) between three-and-a-half and two inches long and about an inch wide; and two staples hold the two discs together.

As shown in FIGS. 3A and 3B the secondary piece 35 (and any disc or secondary piece herein) may have one, two (as shown) three, four or more tabs 37 which fit into corresponding slits or openings 38 on a primary disc 31 to hold the secondary piece to the primary disc. Such tab/slit apparatus may be used with or without staples 36 or other adhesives, connectors, etc.

FIGS. 4A and 4B show a flying disc 40 according to the present invention with a disc body 43 and a plurality of spaced-apart folded-down portions 46 around the disc perimeter. Portions of the disc body 42 are torn, cut or otherwise removed to permit the folding of the portions 44.

FIG. 5 shows a flying disc 50 with markings or slits 54 around a perimeter of a disc body 52. Portions 56 can be folded down (or up) from the disc body 52 to form a peripheral lip.

FIG. 6 shows a flying disc 60 with markings or slits 64 around a perimeter of a disc body 62. Portions 66 can be folded down (or up) from the disc body 62 to form a peripheral lip.

FIGS. 7A–7E show a variety of flyers with various shapes 71–75, respectively, as viewed from above for flyers according to the present invention and any flying disc herein may have any of these shapes as well as the shape of any desired polygon.

FIG. 8 shows a flying disc 80 according to the present invention which may be any flying disc or flyer disclosed herein. The flying disc 80 has a disc body 82 to which are attached one, two (as shown), three, four or more weight members 83. It has been found that some disc bodies fly better with added weight and/or with an added secondary piece (e.g. as in FIG. 3C). Any weight member may be connected to or attached to a disc body with any attachment, or connection disclosed herein or with any suitable known securement apparatus, device, or method.

FIG. 9A shows a flyer container 90 according to the present invention which has a lower box part 91 for containing an item 99 and an upper flying disc part 92 hingedly connected to the lower box part 91 with a hinge 93. The hinge 93 may be an easily severable or tearable hinge made, e.g., of paper, cardboard, or plastic so that the disc part 92 is separable from the lower box part 91. Alternatively, the lower box part 91 is also a flying disc. The disc part 92 and the lower box part 91 may be any desired size and have any desired dimensions. The item 91 may be any item that fits within the flyer container 90, including, but not limited to, pastries or pizza. In one aspect the entire container 90 is made of plastic in a single mold with either an easily separable etc. hinge as described above or with a sturdier hinge that is not so easily separable.

Figure 10B:
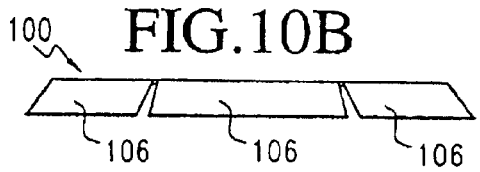
FIGS. 10B and 10C are side views of the flying disc of FIG. 10A.
Figure 10C:
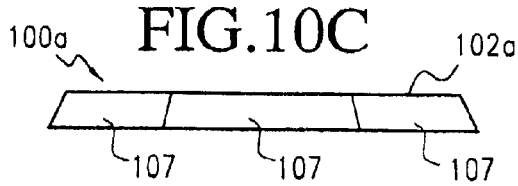

FIG. 10A shows a flying disc 100 with a disc body 102 and markings or slits 104. As shown in FIG. 10B the disc body 102 has been torn or cut and portions 106 have been folded down forming a peripheral lip 108. As shown in FIG. 10C, a flying disc 100*a* has a disc body 102*a* (like the disc body 102, FIG. 10A) that has not been cut or torn and portions 107 have been folded down to form a peripheral lip 109. As may be done with any disc or flyer disclosed herein, FIG. 10C shows that the markings or slits may be eliminated.

FIGS. 11A–11D show multi-disc combinations which each include two flying discs (which may be generally like any flying disc or flyer disclosed herein or in the prior art cited herein, but with the particular disclosed structure for releasably mating together two discs or flyers).

Figure 11A:
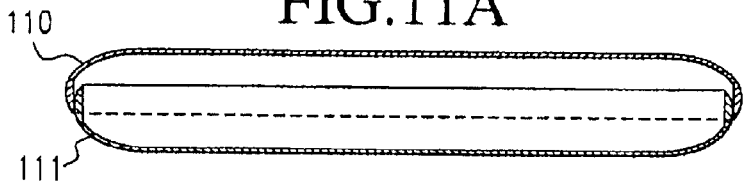
FIGS. 11A–11D are side views in cross-section of flying disc systems according to the present invention.
Figure 11B:
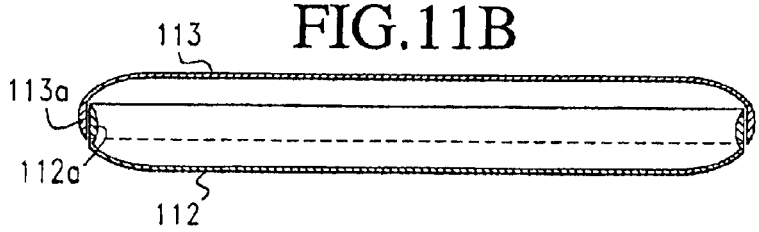

As shown in FIG. 11A a periphery of a flying disc 110 is releasably held by friction fit within a periphery of a slightly larger flying disc 111. As shown in FIG. 11B a lower flying disc 112 has a flattened outer portion 112*a* that abuts a corresponding flattened inner portion 113*a* of a flying disc 113 so that the flying disc 112 is releasably held by a friction fit within the flying disc 113.

Figure 11C:
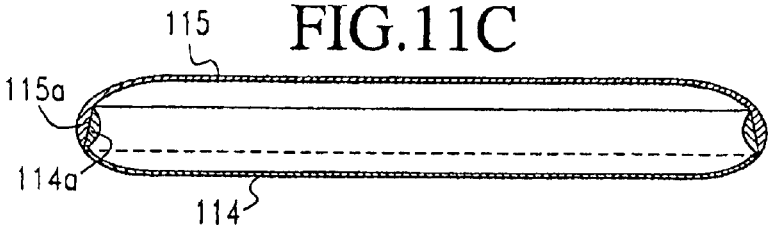

As shown in FIG. 11C a flying disc 114 has a flattened tapered outer portion 114*a* that abuts a corresponding flattened tapered inner portion 115*a* of a flying disc 115 so that the flying disc 114 is releasably held by a friction fit within the flying disc 115.

Figure 11D:
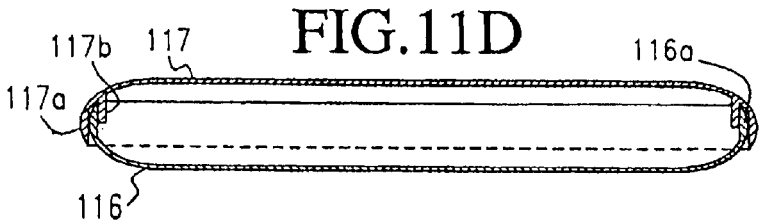

FIG. 11D shows a flying disc 116 with a portion 116*a* releasably held by a friction fit between a portion 117*a* and a portion 117*b* of a flying disc 117. The portion 117*b* may extend around the entire circumference of the disc 117 or two or more spaced-apart parts 117*b* may be used to hold the discs together.

FIGS. 12A–12C show a box 120 according to the present invention which has a box body 122, which may according to the present invention be a unitary structure as shown in FIG. 12C that is fordable into a box or the box 120 may be made of separate pieces of material, e.g. but not limited to, cardboard. As shown in FIGS. 12A and 12C the box is marked with markings 120*a* and 120*b* to indicate the boundaries of a flying disc 124 removable from a top 120*c* of the box and a secondary piece (or additional flying disc) 126 removable from a bottom 120*d* of the box 120. One of the flying disc 124 and the secondary piece (or disc) 126 may be smaller than the other so that, as shown in FIG. 12B, the box top 120*c* may be in an upright position to serve as a target at which (and/or through which) a flying disc, e.g. but not limited to, a secondary piece 126 used as a disc may be thrown. Also, the box itself may be a target into which a disc is thrown. Any disc removed from the box may be reduced in diameter to easily pass through a box opening and/or any opening may be enlarged for this purpose. FIG. 1D shows a disc outline for a disc body 12 with perforations 14 on a box 120.

In one aspect the secondary piece 126 serves as a secondary piece 35 (in FIGS. 3B, 3C). The box 120 may be any known box from which it is possible to form or remove the disc 124 and/or the secondary piece or disc 126. In one particular aspect, the box 120 is sized and configured to be a box for pizza. The box may be (but is not limited to) any box disclosed in any of U.S. Pat. Nos. 6,206,277; 5,595,339; 6,065,669; D 420,583; and all the prior art cited in all these patents—all of which is incorporated fully herein for all purposes. Any desired number and size flying discs and/or secondary pieces or discs may be made of or removed from a single box.

FIG. 13 shows a flyer container 130 which may be any shape disclosed herein as viewed from above and which has a part 131 with an outer portion 133 and an inner portion 134 between which is releasably held by a friction fit an outer part 136 of a flying disc 132.

Figure 14:
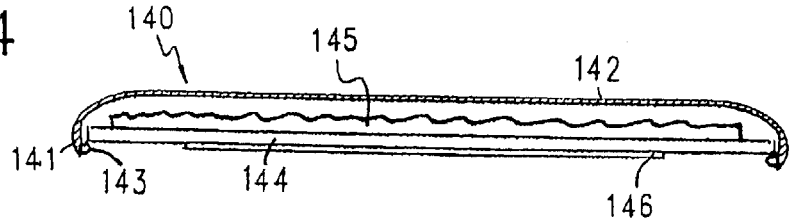
FIG. 14 is a side view in cross-section of a flying disc container according to the present invention.

FIG. 14 shows a flyer container 140 which may be any shape disclosed herein as viewed from above and which has a part 141 of a flying disc 142 with a lip 143. Releasably held within the flying disc 142 is a support 144 whose bottom rests on the lip 143. By flexing the flying disc 142 and/or the support 144, the support is releasably from within the flying disc 142. An item 145, e.g. but not limited to, pastry, or pizza rests on the support 144. The lip 143 may, according to the present invention, be eliminated, and the support 144 held in place by a friction fit between it and the interior of the disc 142.

Any layer or layers of insulating material 146 as shown in FIG. 14 may be used with any flying disc or flyer or container disclosed herein. Any layer or layers 146 in FIG. 14 (or all of them) may be deleted. A middle layer like the middle layer 146 in FIG. 14 may surround the item 145.

Any two flying discs and/or flyers according to the present invention which are appropriately sized and configured may, according to the present invention, be nested one inside the other either for shipment of for use and, in one particular aspect, two such discs and/or flyers are connected together for use, e.g. but not limited to, with staples, tape, or any other connector or connecting method disclosed herein.

Figure 15A:
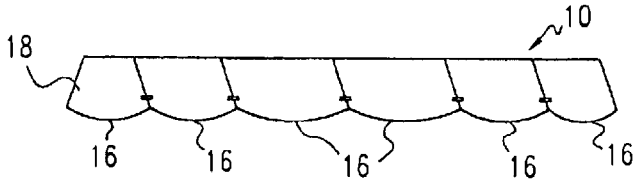
FIGS. 15A and 15B are side views of flying discs according to the present invention.
Figure 15B:
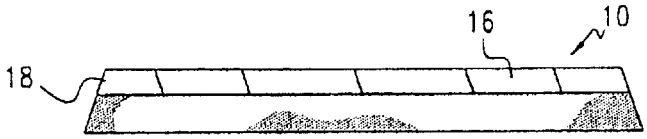

FIGS. 15A and 15B present other versions of the disc 10 of FIG. 1A. As shown in FIG. 15A staples 150 pass through overlapping parts of adjacent portions 16 of the disc 10. These staples hold the portions 16 together (and are used for some or all adjacent portions to connect some or all of them together) and prevent the portions 16 from moving, flopping around or bending back toward or to their original position. Any such portions of any disc or flyer according to the present invention may be thus connected with staples (or alternatively brads, clips, paper clips or other similar connectors).

As shown in FIG. 15B, the disc 10 has tape 152 that is taped around the disc's circumference to tape together the portions 16. Any such portions of any disc or flyer herein may be thus taped together.

Figure 16A:
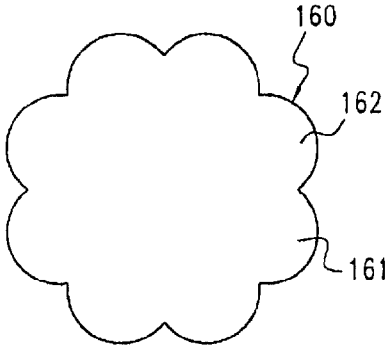
FIGS. 16A, 16B, 17A and 17B are top views of flying discs or flyers according to the present invention.
Figure 16B:
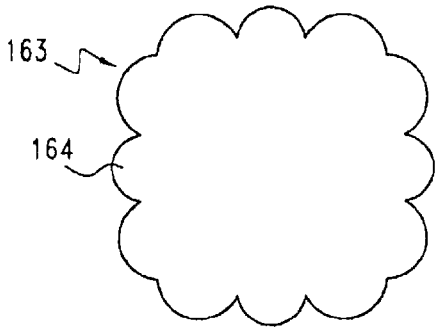

FIG. 16A shows a flying disc 160 according to the present invention with a disc body 162 and a plurality of spaced-apart portions 161 that are to be folded down (e.g. like any folded down or bent down portions of any disc or flyer herein). FIG. 16B shows a flyer 163 according to the present invention with a plurality of spaced-apart portions 164 that are to be folded down like the portions 161, FIG. 16A. Any flyer or disc herein may have any desired number of portions like those of FIG. 16A (portions 161) or FIG. 16B (portions 164). Although these portions are shown as generally "scalloped" shape or semicircular, they may be any desired general shape, including but not limited to, triangular, square, or rectangular.

Figure 17A:
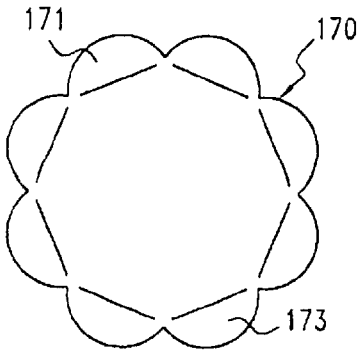
Figure 17B:
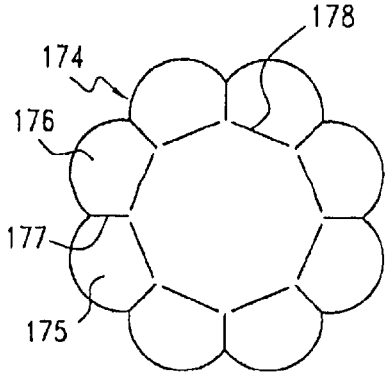

FIG. 17A shows a flying disc 170 with portions 171 (like the portions 161, FIG. 16A) whose folding or bending is facilitated by indentations or incomplete (not all the way through a disc body 172) cuts or grooves 173. Alternatively the indentations, etc. are replaced by lines or markings indicating where the portion is folded or bent. FIG. 17B shows a flying disc 174 with a disc body 175 and spaced-apart portions 176 (like portions 171, FIG. 17A). Indentations or cuts 177 separate the portions 176 and markings 178 (or cuts or indentations) indicate where the portions 176 are to be folded or bent. Any disc or flyer herein may employ similar suitable indentations 177 and/or markings (or cuts) 178.

The present invention, therefore, provides in certain, but not necessarily all embodiments, a flying disc with a disc body having an outer perimeter and, optionally, a plurality of cuts spaced-apart around the outer perimeter, at least one portion of the disc body between at least one pair of the cuts, the at least one portion folded at an angle to, up from or down from the disc body, or without such cuts but with one or more folded down portions; and/or a disc body having an outer perimeter and a plurality of portions of the disc body folded down from the disc body around the outer perimeter. Such a flying disc may also include one, some (in any possible combination) or all of the following: a secondary piece (or pieces) or disc (or discs) connected to an underside or top side of the disc body; wherein the secondary piece is connected to the disc body with at least one staple, with adhesive, or tape; wherein the secondary piece is for facilitating flight of the disc body and has indicia or advertising thereon; wherein the secondary piece is shaped similar to the disc body; wherein the secondary piece has at least one tab and the disc body has at least one slit or opening corresponding to the at least one tab, the at least one tab insertable into the at least one slit to connect the secondary piece to the disc body, or with tab(s) on the disc body and corresponding slit(s) or openings(s) on the secondary piece; wherein the at least one tab is at least two spaced-apart tabs and the at least one slit is at least two spaced-apart slits, one slit corresponding to each tab; wherein the at least one portion is a plurality of adjacent portions, the at least one pair of cuts is a plurality of pairs of cuts, each portion of the plurality of adjacent portions folded between a pair of the cuts (cuts completely through the disc body or only extending partially thereinto); a secondary piece connected to an underside of the disc body, the secondary piece for facilitating flight of the disc body and/or for bearing indicia and/or ads material, and the secondary piece positioned within the adjacent portions that are folded down; wherein the disc body has a shape as viewed from above from the group consisting of triangular, rectangular, square, pentagonal, hexagonal, septagonal, octagonal, nonagonal, decagonal and polygonal; at least one light or piece of light material on the disc body; a piece of material larger than the disc body from which the disc body is separatable, e.g., but not limited to part of a box, e.g. but not limited to a cardboard box; wherein the cardboard box is for holding a pizza; wherein the piece of material is suitable as a target at which and/or into which the flying disc or any disc is thrown; wherein the flying disc is made of rigid material from the group consisting of paper, cardboard, plastic, metal, foil and foamboard; a secondary flying disc removed from the disc body; wherein the secondary flying disc has a disc body having an outer perimeter and a plurality of cuts spaced-apart around the outer perimeter, and portions of the disc body between pairs of the cuts, the portions folded down from the disc body; at least one tertiary disc removed from the secondary flying disc; wherein the at least one tertiary disc has a disc body having an outer perimeter and a plurality of cuts spaced-apart around the outer perimeter, and portions of the disc body between pairs of the cuts, the portions folded down from the disc body; wherein the at least one tertiary disc is a plurality of tertiary discs; wherein the secondary piece has an opening therein suitable for receiving and holding a portion of the disc body to form a disc body—secondary piece combination so that one of the disc body and secondary piece is held upright; and/or wherein the secondary flying disc has an opening therein suitable for receiving and holding a portion of the disc body to form a disc body—secondary flying disc combination so that one of the disc body and flying disc piece is held upright.

It is within the scope of this invention for the "cuts" described above to be made with any suitable cutting tool, scissors, knife, bladed instrument, etc.; and it is also within the scope of this invention for the portions to be folded or bent from a disc body made of foldable material to be folded or bent manually; and for such manual folding or bending the material is, preferably, easily torn if necessary and if no cuts, etc. are provided, easily foldable or bendable, and sufficiently lacking in memory that folded or bent portions stay in their folded or bent position or at least substantally so to provide a shape that facilitates desired flight, e.g., relatively flat flight of a flyer or disc.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. §102 and satisfies the conditions for patentability in §102. The invention claimed herein is not obvious in accordance with 35 U.S.C. §103 and satisfies the conditions for patentability in §103. This specification and the claims that follow are in accordance with all of the requirements of 35 U.S.C. §112. The inventors may rely on the Doctrine of Equivalents to determine and assess the scope of their invention and of the claims that follow as they may pertain to apparatus not materially departing from, but outside of, the literal scope of the invention as set forth in the following claims.

What is claimed is:

1. An object of manufacture comprising a primary piece of material, a disc body contained within and separable from the primary piece of material, the disc body having an outer perimeter, the outer perimeter indicated by marking on the primary piece of material, the disc body having a plurality of spaced-apart cut lines marked on the disc body for indicating locations of cuts to be made on the disc body to form a plurality of portions of the disc body foldable with respect to the disc body at said outer perimeter to facilitate flight of the disc body and foldable to overlap a side of an adjacent portion of said plurality of portions.

2. The object of manufacture of claim 1 wherein the primary piece of material is part of a box.

3. The object of manufacture of claim 2 wherein the box is a cardboard box.

4. The object of manufacture of claim 3 wherein the cardboard box is a pizza box.

5. The object of manufacture of claim 1 wherein the primary piece of material minus the disc body forms a target at which the disc body be thrown.

6. A flying disc comprising a disc body having an outer perimeter and a plurality of cuts spaced-apart around the outer perimeter, a plurality of portions of the disc body, each portion of the plurality of portions of the disc body between two cuts of the plurality of cuts, each said portion folded from and at an angle to the disc body for facilitating flight of the flying disc, and said portions of the plurality of portions forming a downwardly projecting lip around the outer perimeter of the disc body.

7. The flying disc of claim 6 further comprising a secondary piece connected to an underside of the disc body, the secondary piece for facilitating flight of the disc body.

8. The flying disc of claim 7 further comprising the secondary piece positioned within the plurality of portions of the disc body.

9. The flying disc of claim 6 wherein the disc body is formed by separating the disc body from a piece of material.

10. The flying disc of claim 9 wherein the piece of material is part of a box.

11. The flying disc of claim 10 wherein the box is a cardboard box for holding a pizza.

12. A flying disc comprising a disc body having an outer perimeter and a plurality of outer portions spaced-apart around the outer perimeter, at least one of the outer portions of said plurality of outer portions between and adjacent to two other of said outer portions of said plurality of outer portions, the disc body having a plurality of cuts spaced-apart around the outer perimeter, the plurality of cuts comprising a plurality of pairs of cuts, each pair of cuts having therebetween an outer portion of said plurality of outer portions, each outer portion of said plurality of outer portions at an angle to the disc body to facilitate flight of the flying disc, and part of each said outer portion overlapping a part of an adjacent outer portion of said plurality of outer portions.

13. The flying disc of claim 12 further comprising a secondary piece connected to the disc body for facilitating flight of the flying disc.

14. The flying disc of claim 12 wherein the disc body is made of cardboard having a thickness, the disc body has a shape when viewed from above, the secondary piece has a shape similar to the shape of the disc body when viewed from above, and the secondary piece has a thickness substantially equal to the thickness of the disc body.

15. The flying disc of claim 13 wherein the secondary piece has at least one tab and the disc body has at least one slit corresponding to the at least one tab, the at least one tab insertable into the at least one slit to connect the secondary piece to the disc body.

16. The flying disc of claim 13 further comprising the secondary piece positioned within said plurality of outer portions.

17. The flying disc of claim 12 wherein the disc body has a shape as viewed from above from the group consisting of triangular, rectangular, square, pentagonal, hexagonal, septagonal, octagonal nonagonal, and decagonal.

18. The flying disc of claim 6 wherein the plurality of outer portions of the disc body are all folded in one direction from the disc body.

19. The flying disc of claim 6 wherein the disc body is cardboard.

* * * * *